US008542857B2

(12) United States Patent
Åsnes et al.

(10) Patent No.: US 8,542,857 B2
(45) Date of Patent: Sep. 24, 2013

(54) BONE CONDUCTION DEVICE WITH A MOVEMENT SENSOR

(75) Inventors: Kristian Åsnes, Molndal (SE); Patrik Wilhelm Strömsten, Molnlycke (SE); Marcus Andersson, Gothenburg (SE); Christian M. Peclat, Neuchatel (CH)

(73) Assignee: Cochlear Limited, NSW (AU)

( * ) Notice: Subject to any disclaimer, the term of this patent is extended or adjusted under 35 U.S.C. 154(b) by 214 days.

(21) Appl. No.: 12/982,764

(22) Filed: Dec. 30, 2010

(65) Prior Publication Data

US 2011/0158443 A1 Jun. 30, 2011

Related U.S. Application Data

(63) Continuation-in-part of application No. 12/355,380, filed on Jan. 16, 2009.

(60) Provisional application No. 61/041,185, filed on Mar. 31, 2008.

(51) Int. Cl.
*H04R 25/00* (2006.01)

(52) U.S. Cl.
USPC ..... 381/326; 381/380

(58) Field of Classification Search
USPC ..... 381/151, 312, 326, 380
See application file for complete search history.

(56) References Cited

U.S. PATENT DOCUMENTS

| | | | | |
|---|---|---|---|---|
| 4,612,915 | A | 9/1986 | Hough et al. | |
| 5,604,812 | A | 2/1997 | Meyer | |
| 5,735,790 | A | 4/1998 | Hakansson et al. | |
| 5,935,170 | A | 8/1999 | Hakansson et al. | |
| 6,115,477 | A | 9/2000 | Filo et al. | |
| 6,560,468 | B1 | 5/2003 | Boesen | |
| 6,751,334 | B2 | 6/2004 | Hakansson | |
| 7,043,040 | B2 * | 5/2006 | Westerkull | 381/326 |
| 2002/0122563 | A1 | 9/2002 | Schumaier | |
| 2004/0234091 | A1 | 11/2004 | Westerkull | |
| 2005/0201574 | A1 | 9/2005 | Lendhardt | |
| 2005/0226446 | A1 * | 10/2005 | Luo et al. | 381/312 |
| 2006/0018488 | A1 | 1/2006 | Viala et al. | |
| 2006/0239468 | A1 | 10/2006 | Desloge | |

(Continued)

FOREIGN PATENT DOCUMENTS

| | | |
|---|---|---|
| DE | 2451977 | 5/1975 |
| EP | 0340594 | 11/1989 |

(Continued)

OTHER PUBLICATIONS

International Search Report; International Application No. PCT/AU2009/000366 mailed Aug. 13, 2009 (3 pages).

(Continued)

*Primary Examiner* — Brian Ensey
(74) *Attorney, Agent, or Firm* — Kilpatrick, Townsend & Stockton, LLP.

(57) ABSTRACT

A bone conduction device including a coupling configurable to form a coupling with a bone, a transducer module configurable to vibrate in accordance with one or more operational characteristics of the device; and a sensor module configurable to adjust the one or more operational characteristics in response to one or more of a reorientation of a portion of the device and a movement of the portion relative to the coupling.

29 Claims, 9 Drawing Sheets

(56) References Cited

U.S. PATENT DOCUMENTS

| | | | | |
|---|---|---|---|---|
| 2007/0195979 | A1 | 8/2007 | Thomasson et al. | |
| 2009/0161892 | A1 | 6/2009 | Servello et al. | |
| 2009/0310804 | A1 | 12/2009 | Parker et al. | |
| 2010/0098269 | A1* | 4/2010 | Abolfathi et al. | 381/151 |
| 2010/0202637 | A1 | 8/2010 | Cornelisse et al. | |

FOREIGN PATENT DOCUMENTS

| | | |
|---|---|---|
| WO | WO-0193634 | 12/2001 |
| WO | WO-03001845 | 1/2003 |
| WO | WO 2004/013977 | 2/2004 |
| WO | WO 2007/023192 | 3/2007 |

OTHER PUBLICATIONS

Extended European Search Report, European Application No. 09728833.6 mailed Apr. 1, 2011 (6 pages).

Vermiglio et al. "A Measurement of Sound Level Perception when using the Bone-Anchored Hearing Aid (BAHA) for Trans-Cranial Stimulation of Individuals with Single-Sided Deafness" House Ear Institute. Advance Hearing Science, International Hearing Aid Research Conference, Aug. 2004, Lake Tahoe, CA.

* cited by examiner

BONE CONDUCTION DEVICE WITH A MOVEMENT SENSOR

CROSS-REFERENCE TO RELATED APPLICATIONS

The present application is a continuation-in-part of U.S. patent application Ser. No. 12/355,380, filed Jan. 16, 2009, which claims the benefit of U.S. Provisional Patent Application No. 61/041,185, filed Mar. 31, 2008, which are each hereby incorporated by reference herein.

BACKGROUND

1. Field of the Invention

The present invention is generally directed to a bone conduction device, and more particularly, to a bone conduction device having a movement sensor.

2. Related Art

Hearing loss, which may be due to many different causes, is generally of two types, conductive or sensorineural. In many people who are profoundly deaf, the reason for their deafness is sensorineural hearing loss. This type of hearing loss is due to the absence or destruction of the hair cells in the cochlea which transduce acoustic signals into nerve impulses. Various prosthetic hearing implants have been developed to provide individuals who suffer from sensorineural hearing loss with the ability to perceive sound. One such prosthetic hearing implant is referred to as a cochlear implant. Cochlear implants use an electrode array implanted in the cochlea to provide an electrical stimulus directly to the auditory nerve, thereby causing a hearing sensation.

Conductive hearing loss occurs when the normal mechanical pathways to provide sound to hair cells in the cochlea are impeded, for example, by damage to the ossicular chain or ear canal. Individuals suffering from conductive hearing loss may still have some form of residual hearing because the hair cells in the cochlea are generally undamaged.

Individuals suffering from conductive hearing loss are typically not considered to be candidates for a cochlear implant due to the irreversible nature of the cochlear implant. Specifically, insertion of the electrode array into a recipient's cochlea destroys a majority of hair cells within the cochlea. This results in the loss of residual hearing by the recipient.

Rather, individuals suffering from conductive hearing loss typically receive an acoustic hearing aid, referred to as a hearing aid herein. Hearing aids rely on principles of air conduction to transmit acoustic signals through the outer and middle ears to the cochlea. In particular, a hearing aid typically uses an arrangement positioned in the recipient's ear canal to amplify a sound received by the outer ear of the recipient. This amplified sound reaches the cochlea and causes motion of the cochlea fluid and stimulation of the cochlea hair cells.

Unfortunately, not all individuals who suffer from conductive hearing loss are able to derive suitable benefit from hearing aids. For example, some individuals are prone to chronic inflammation or infection of the ear canal and cannot wear hearing aids. Other individuals have malformed or absent outer ear and/or ear canals as a result of a birth defect, or as a result of common medical conditions such as Treacher Collins syndrome or Microtia. Furthermore, hearing aids are typically unsuitable for individuals who suffer from single-sided deafness (total hearing loss only in one ear) or individuals who suffer from mixed hearing losses (i.e., combinations of sensorineural and conductive hearing loss).

When an individual having fully functioning hearing receives an input sound, the sound is transmitted to the cochlea via two primary mechanisms: air conduction and bone conduction. As noted above, hearing aids rely primarily on the principles of air conduction. In contrast, other devices, referred to as bone conduction devices, rely predominantly on vibration of the bones of the recipient's skull to provide acoustic signals to the cochlea.

Those individuals who cannot derive suitable benefit from hearing aids may benefit from bone conduction devices. Bone conduction devices convert a received sound into a mechanical vibration representative of the received sound. This vibration is then transferred to the bone structure of the skull, causing vibration of the recipient's skull. This skull vibration results in motion of the fluid of the cochlea. Hair cells inside the cochlea are responsive to this motion of the cochlea fluid, thereby generating nerve impulses, which result in the perception of the received sound.

SUMMARY

In one aspect of the invention, a bone conduction device is provided. The bone conduction device comprises a coupling configurable to form a coupling with a bone, a transducer module configurable to vibrate in accordance with one or more operational characteristics of the device, and a sensor module configurable to adjust the one or more operational characteristics in response to one or more of a reorientation of a portion of the device and a movement of the portion relative to the coupling.

In another aspect of the invention, a method of operating a bone conduction device is provided. The bone conduction device comprises a sensor, a coupling and a transducer. The method comprises vibrating a bone, via the coupling, in accordance with one or more operational characteristics of the device, and adjusting the one or more operational characteristics of the device in response to at least one of a reorientation of a portion of the device and a movement of the portion relative to the coupling.

BRIEF DESCRIPTION OF THE DRAWINGS

Illustrative embodiments of the present invention are described herein with reference to the accompanying drawings, in which.

DETAILED DESCRIPTION

Figure 1:
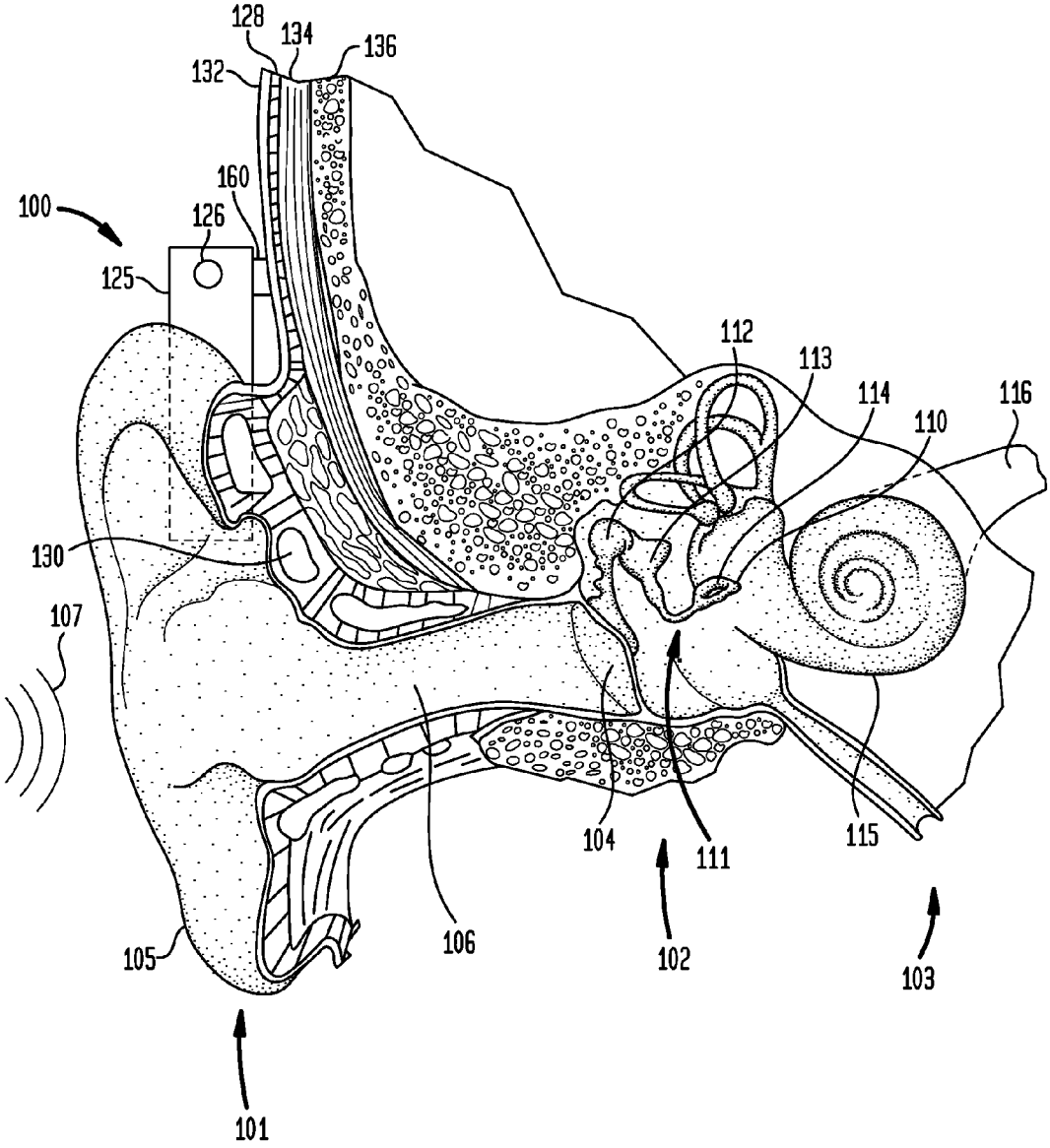
FIG. 1 is a perspective view of an exemplary medical device, namely a bone conduction device, in which embodiments of the present invention may be advantageously implemented.

Embodiments of the present invention are generally directed to a bone conduction hearing device ("bone conduction device") for converting a received sound signal into a mechanical force for delivery to a recipient's skull. The bone conduction device includes a sensor module that enables the recipient to alter various operational characteristics in the bone conduction device by moving the device itself.

Conventional bone conductions devices allow recipients to control some features or operational characteristics of the device, such as the volume setting of the device, certain aspects of the programming of the device, and the power setting of the device (e.g., turning the device on or off). Typically, conventional bone conduction devices include one or more mechanical buttons or wheels on or in the housing of the device by which a recipient may adjust operational characteristics of the device. Some recipients, especially those having reduced or impaired motor functions, may find these mechanical controls difficult to operate, or at least difficult to operate quickly, especially when the mechanical controls are relatively small. Additionally, the typical position of the bone conduction device behind the recipient's ear and toward the back of the head may add to the difficulty of locating as well as manipulating the mechanical controls, which may be relatively small. As such, a recipient may remove the bone conduction device from his or her head in order to manipulate the mechanical controls of the device. Removing the device to manipulate the controls is not only time-consuming, but also puts undue strain on the interface between the bone conduction device and the recipient's tissue. In addition, spaces may exist in the housing around mechanical controls such as buttons and wheels, which may provide a pathway for water or other contaminants to enter the bone conduction device.

Accordingly, a bone conduction device in accordance with embodiments of the present invention includes a sensor module that enables the recipient to alter various operational characteristics in the bone conduction device by moving the device itself. For example, a bone conduction device in accordance with embodiments of the present invention may sense the movement caused by a recipient touching the device. In such embodiments, the recipient is able to adjust and/or alter various operational characteristics of the device by touching the housing of the device. Thus, in certain embodiments, this sensor module may replace the various mechanical controls, and thereby eliminate many of the above-described drawbacks associated with those controls. In some embodiments, eliminating buttons and wheels from the device housing may make the device more resistant to water and other contaminants. In addition, certain such embodiments are less mechanically complex than devices with mechanical controls, which may improve device reliability. Moreover, in some embodiments, the sensor module may occupy less space in the device than various mechanical controls, which may allow a reduction in the size of the device, or a reallocation of that space for other features.

Additionally, a bone conduction device allowing a recipient to adjust and/or alter various operational characteristics of the device by touching the housing of the device, in accordance with embodiments of the present invention, may also be simpler to operate than the mechanical controls of a conventional device. In such embodiments, recipients may find the device easier to operate while positioned on the head, and recipients with impaired motor function may find the device easier to operate as well. Mechanical controls also experience wear and tear over the life of the device. However, eliminating these mechanical controls in certain embodiments of the present invention may provide a device that experiences less wear and tear and may require less repair. Additionally, new bone conduction device designs often include new mechanical control layouts, which may be due to difficulty finding sufficient space to accommodate mechanical controls in new devices. A sensor module of a bone conduction device in accordance with embodiments of the present invention may be used as a standard component across many bone conduction device designs, since mechanical controls may be eliminated.

FIG. 1 is a cross sectional view of a human ear and surrounding area, along with a side view of one of the embodiments of a bone conduction device 100. In fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 110 through three bones of middle ear 102, collectively referred to as the ossicles 111 and comprising the malleus 112, the incus 113 and the stapes 114. Bones 112, 113 and 114 of middle ear 102 serve to filter and amplify acoustic wave 107, causing oval window 110 to articulate, or vibrate. Such vibration sets up waves of fluid motion within cochlea 115. The motion, in turn, activates tiny hair cells (not shown) that line the inside of cochlea 115. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. As shown, bone conduction device 100 may be positioned behind outer ear 101 of the recipient; however it is noted that device 100 may be positioned in any suitable manner.

In the embodiments illustrated in FIG. 1, bone conduction device 100 comprises a housing 125 having at least one microphone 126 positioned therein or thereon. Housing 125 is coupled to the body of the recipient via coupling 160. Bone conduction device 100 may comprise a signal processor, a transducer, transducer drive components and/or various other electronic circuits/devices.

In accordance with embodiments of the present invention, an anchor system (not shown) may be implanted in the recipient. The anchor system may be fixed to bone 136. In various embodiments, the anchor system may be implanted under skin 132 within muscle 134 and/or fat 128 or the hearing device may be anchored in another suitable manner. In certain embodiments, a coupling 160 attaches device 100 to the anchor system. As used herein, the term "coupling" may refer to one or more components that attach a bone conduction device to an anchor system, or to those one or more components and the anchor system.

Figure 2:
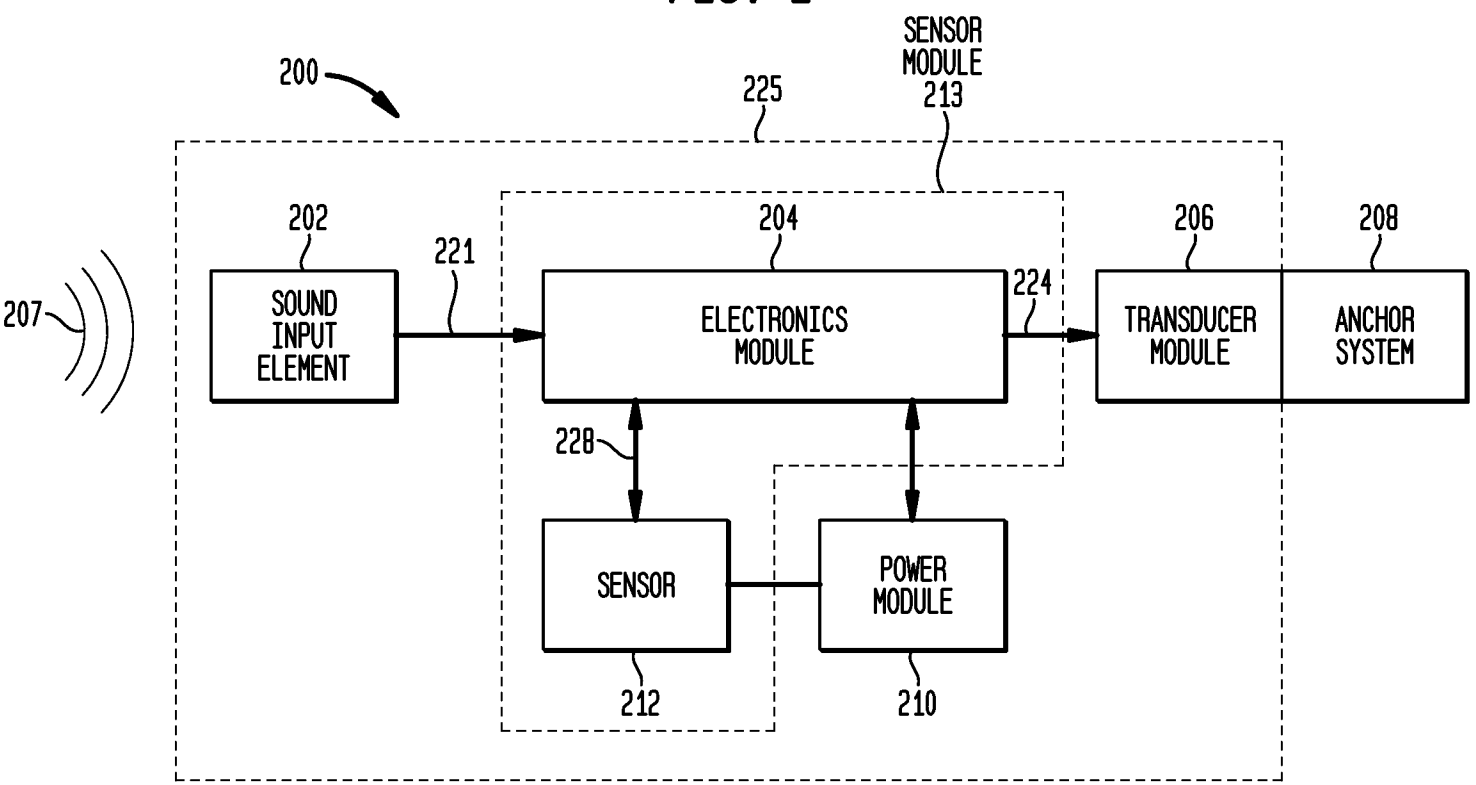
FIG. 2 is a functional block diagram of a bone conduction device, such as the bone conduction device of FIG. 1, in accordance with embodiments of the present invention.

A functional block diagram of one embodiment of bone conduction device 100, referred to as bone conduction device 200, is shown in FIG. 2. In the illustrated embodiment, sound 207 is received by sound input elements 202, which may be, for example, a microphone configured to receive sound 207, and to convert sound 207 into an electrical signal 221. Or, for example, the sound input element 202, or an additional sound input element, might be an interface that the recipient may connect to a sound source, such as for example a jack for receiving a plug that connects to a headphone jack of a portable music player (e.g., MP3 player) or cell phone. It should be noted that these are but some exemplary sound input elements, and sound input element 202 may be any component or device capable of providing a signal regarding a sound. Although bone conduction device 200 is illustrated as including one sound input element 202, in other embodiments, bone conduction device may comprise any number of sound input elements.

Bone conduction device 200 further includes a sensor module 213 that comprises a sensor 212 and an electronics module 204. Sensor module 213 detects certain movements of housing 225 of device 200 using sensor 212. As described further below, in certain embodiments sensor module 213 may sense a reorientation of housing 225 or sense the movement of housing 225 relative to a portion of anchor system 208. As used herein, by sensing certain movements of housing 225, sensor module 213 may allow the recipient to interact with device 200 by moving housing 225. For example, sensor module 213 may allow the recipient to adjust one or more operational characteristics of the device by moving housing 225. Settings for the operational characteristics of the device may be stored in electronics module 204, and exemplary operational characteristics of a bone conduction device are described in more detail below. Additionally, sensor module 213 communicates with electronics module 204 via signal line 228.

As shown in FIG. 2, electrical signal 221 is output by sound input element 202 to an electronics module 204. Electronics module 204 is configured to convert electrical signals 221 into an adjusted electrical signal 224. Electronics module 204 may include a signal processor, control electronics, transducer drive components, and a variety of other elements, including electronic circuits/devices. Based on adjusted electrical signal 224, transducer module 206 provides an output force to the skull of the recipient via anchor system 208. Additionally, in certain embodiments, sound input element 202 may transmit information indicative of the position of the sound input element 202 (e.g., its location in the bone conduction device 200) in electrical signal 221, in addition to sending information regarding sound 207.

As shown in FIG. 2, a transducer module 206 receives adjusted electrical signal 224 and generates a mechanical output force that is delivered to the skull of the recipient via an anchor system 208 coupled to bone conduction device 200. Delivery of this output force causes one or more of motion or vibration of the recipient's skull, thereby activating the hair cells in the cochlea via cochlea fluid motion. In embodiments, the mechanical output force that is delivered to the skull is generated in accordance with the operational characteristics of device 200. Additionally, in certain embodiments, after adjusting one or more operational characteristics of the device, as described above, the mechanical output force that is delivered to the skull may be generated in accordance with the adjusted operational characteristics of device 200.

FIG. 2 also illustrates a power module 210. Power module 210 provides electrical power to one or more components of bone conduction device 200. For ease of illustration, power module 210 has been shown connected only to sensor 212 and electronics module 204. However, it should be appreciated that power module 210 may be used to supply power to any electrically powered circuits/components of bone conduction device 200.

In the embodiment illustrated in FIG. 2, sound input element 202, electronics module 204, transducer module 206, power module 210 and sensor module 212 have all been shown as integrated in a single housing, referred to as housing 225. However, it should be appreciated that in certain embodiments, one or more of the illustrated components may be housed in separate or different housings. Similarly, it should also be appreciated that in such embodiments, direct connections between the various modules and devices are not necessary and that the components may communicate, for example, via wireless connections.

Figure 3:
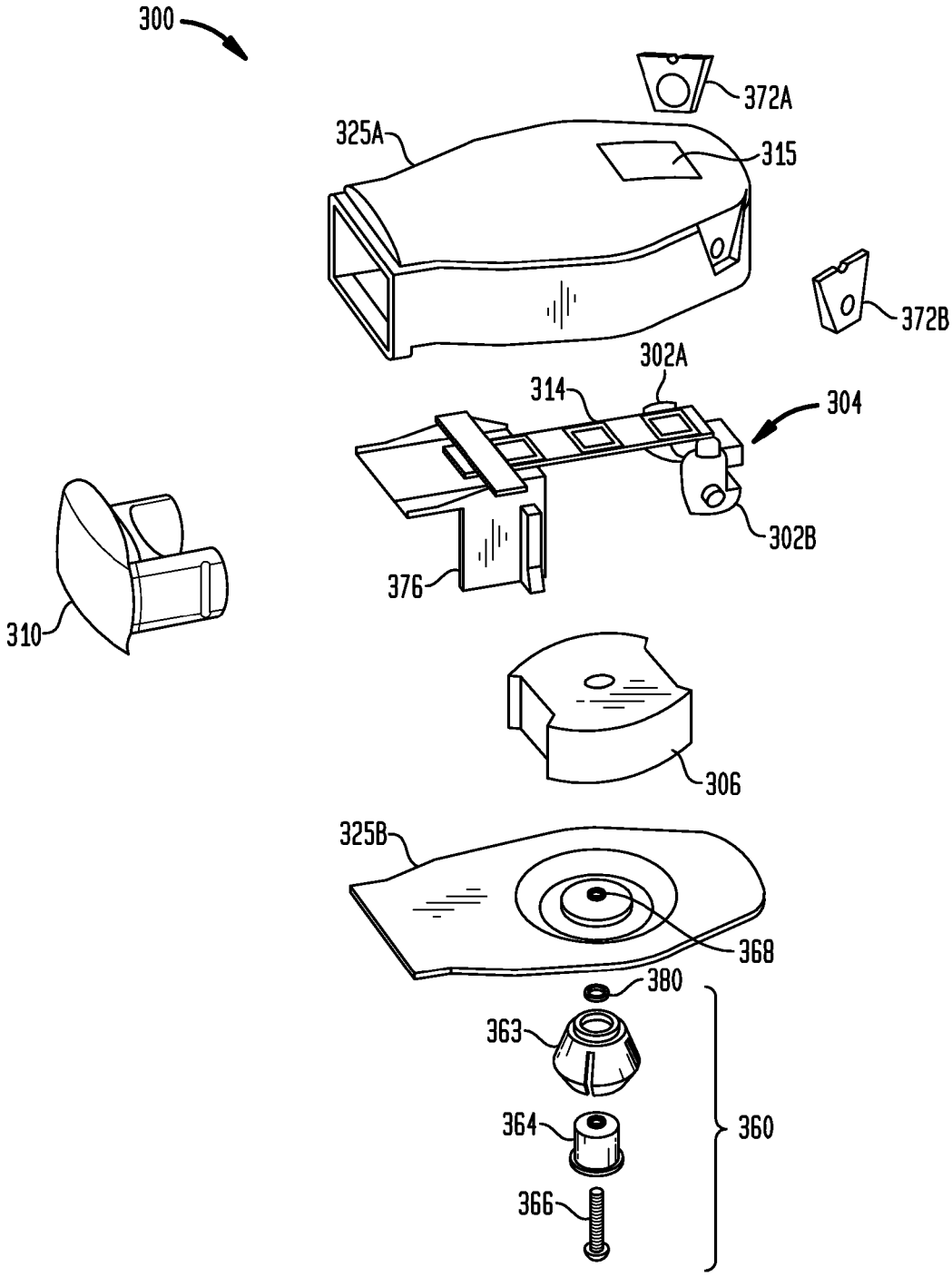
FIG. 3 is an exploded view of an embodiment of a bone conduction device in accordance with one embodiment of FIG. 2.

FIG. 3 illustrates an exploded view of one embodiment of bone conduction device 200 of FIG. 2, referred to herein as bone conduction device 300. As shown, bone conduction device 300 comprises an embodiment of electronics module 204, referred to as electronics module 304. As illustrated, electronics module 304 includes a printed circuit board 314 (PCB) to electrically connect and mechanically support the components of electronics module 304. Further, as noted above, electronics module 304 may also include a signal processor, transducer drive components and control electronics. For ease of illustration, these components have not been illustrated in FIG. 3.

A plurality of sound input elements are attached to PCB 314, shown as microphones 302*a* and 302*b* to receive a sound. As illustrated, the two microphones 302*a* and 302*b* are positioned equidistant or substantially equidistant from the longitudinal axis of the device; however, in other embodiments microphones 302*a* and 302*b* may be positioned in any suitable position. By being positioned equidistant or substantially equidistant from the longitudinal axis, bone conduction device 300 can be used on either side of a patient's head. The microphone facing the front of the recipient is generally chosen as the operating microphone using a selection circuit, so that sounds in front of the recipient can be heard; however, the microphone facing the rear of the recipient can be chosen, if desired. It is noted that it is not necessary to use two or a plurality of microphones and only one microphone may be used in any of the embodiments described herein.

Bone conduction device 300 further comprises a battery shoe 310 for supplying power to components of device 300. Battery shoe 310 may include one or more batteries. As shown, PCB 314 is attached to a connector 376 configured to mate with battery shoe 310. This connector 376 and battery shoe 310 may be, for example, configured to releasably snap-lock to each other. Additionally, one or more battery connects (not shown) may be disposed in connector 376 to electrically connect battery shoe 310 with electronics module 304.

In the embodiment illustrated in FIG. 3, bone conduction device 300 further includes a two-part housing 325, comprising first housing portion 325A and second housing portion 325B. Housing portions 325 are configured to mate with one another to substantially seal bone conduction device 300. In certain embodiments of the present invention, the housing of a bone conduction device may include one or more physical divisions. In some embodiments, the housing is physically divided into multiple containers configured to be physically attached to one another, each of which is capable of at least partially containing one or more elements of the bone conduction device.

In the embodiment of FIG. 3, first housing portion 325A includes an opening for receiving battery shoe 310. This opening may be used to permit battery shoe 310 to inserted or removed by the recipient through the opening into/from connector 376. Also in the illustrated embodiment, microphone covers 372 can be releasably attached to first housing portion 325A. Microphone covers 372 can provide a barrier over microphones 302 to protect microphones 302 from dust, dirt or other debris. Bone conduction device 300 further may include sensor module 212 (not shown in FIG. 3), embodiments of which will be discussed in further detail below with reference to FIGS. 6-9B.

Also as shown in FIG. 3, bone conduction device 300 may comprise a transducer module 206, referred to as transducer module 306, and an anchor system that is an embodiment of anchor system 208. Transducer 306 may be used to generate an output force to the skull of the recipient via the anchor system, which causes movement of the cochlea fluid to enable sound to be perceived by the recipient. In embodiments, the anchor system comprises a coupling 360 configured to be operably attached to a component disposed in the recipient (not shown). In the embodiment illustrated in FIG. 3, the component disposed in the recipient is an implanted anchor that transfers vibration from coupling 360 to the skull of the recipient. In embodiments, the implanted anchor may include an abutment attached to the recipient's skull by a screw such that the abutment is disposed at least partially above the recipient's skin. In some embodiments, the abutment and the screw may be integrated into a single implantable component. The abutment and the screw may each be formed from titanium. Coupling 360 comprises an outer portion 636, an inner portion 364, and a screw 366 that attaches inner portion 364 to second housing portion 325B. Coupling 360 is configured to be releasably attached to the implanted anchor to create a vibratory pathway between transducer 306 and the skull of the recipient. Using coupling 360, the recipient may detach the hearing device 300 from the implanted anchor, and subsequently releasably reattach the hearing device 300 to the implanted anchor using coupling 360. In the embodiment illustrated in FIG. 3, bone conduction device 300 utilizes the percutaneous transfer of mechanical energy (e.g., mechanical force or vibration) to the recipient's skull. In other embodiments, a bone conduction device may utilize the transcutaneous transfer of mechanical energy.

In alternative embodiments, the anchor system of device 300 may include any type of coupling and corresponding component disposed in the recipient, wherein the coupling is configured to be operably attached to the component disposed in the recipient. In certain embodiments, for example, the component may be a metallic object disposed in the recipient and the coupling may include a magnet that operably attaches to the metallic object through magnetic attraction. In other embodiments, the component disposed in the recipient may be an implanted magnet, and the coupling may include a magnet or other metallic object that operably attaches to the implanted magnet through magnetic attraction. In such embodiments, the bone conduction device 300 utilizes the trancutenous transfer of mechanical energy (e.g., mechanical force or vibration) to the recipient's skull. A sensor module in accordance with embodiments of the present invention may be utilized in these alternative bone conduction devices as well.

In still other embodiments, the anchor system may include a coupling configured to be operably attached to the recipient without being attached to any component implanted in the recipient. In such embodiments, the bone conduction device 300 utilizes the trancutenous transfer of mechanical energy (e.g., mechanical force or vibration) to the recipient's skull. In some embodiments, the bone conduction device may be held in place on the recipient's head by a band placed around the recipient's head. In embodiments, this band may hold the bone conduction device, and specifically a coupling, against the outside of the recipient's head with sufficient force to transfer vibration (or other mechanical force) from the coupling to the head. The band may be a soft band, or a relatively more stiff metallic headband. As another alternative, the bone conduction device may be held to the recipient's head by the arm of a pair of eyeglasses configured to hold the coupling of the device to the head of the recipient's head with sufficient force to transfer vibration to the head. In other embodiments, the bone conduction device may be held to the recipient's body by a neck loop. A sensor module in accordance with embodiments of the present invention may be utilized in these alternative bone conduction devices as well.

In certain embodiments, as illustrated in FIG. 3, coupling 360 may be configured to attach to second housing portion 325B. As such, vibration from transducer 306 may be provided to coupling 360 through housing 325B. As illustrated, housing portion 325B may include an opening 368 to allow a screw 366 to be inserted through opening 368 to attach transducer 306 to coupling 360. In such embodiments, an O-ring 380 may be provided to seal opening 368 around the screw. As used herein, the term "attach" refers to both the direct and indirect attachment of components. In certain embodiments, one or more components may be disposed between transducer 306 and coupling 360 such that transducer 306 and coupling 360 are indirectly attached, with the one or more components providing a rigid connection between transducer 306 and coupling 360. In other embodiments, coupling 360 may be directly attached to transducer 306. In certain embodiments, such as those illustrated in FIGS. 6-9B, housing portion 325B may include an opening to allow coupling 360 to pass through housing portion 325B to attach to transducer 306. In certain such embodiments, coupling 360 and transducer 306 are directly attached and transducer 306 applies vibration directly to coupling 360. In alternative embodiments, coupling 360 is indirectly attached to transducer 306.

Figure 4:
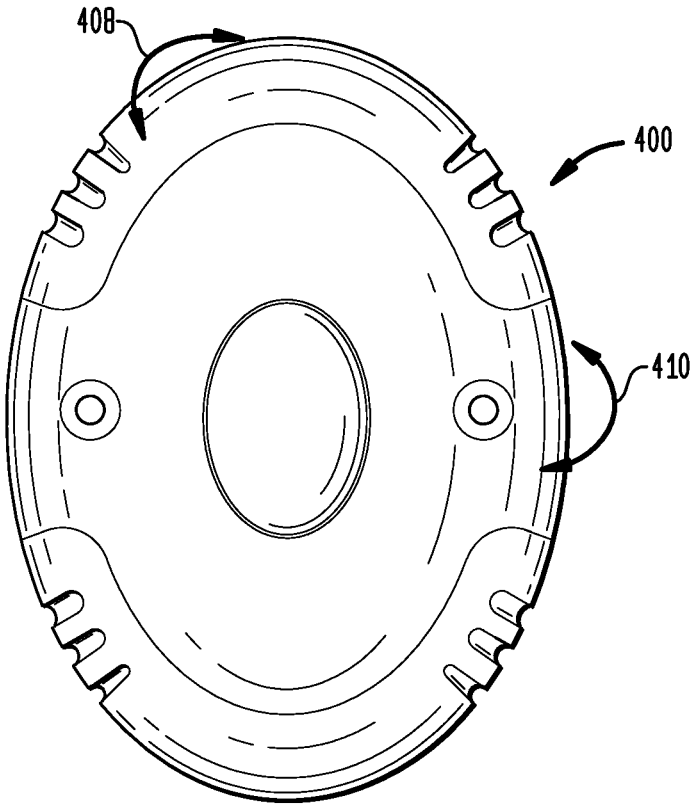
FIG. 4 illustrates a bone conduction device, in accordance with embodiments of the present invention, wherein operational characteristics of the bone conduction device may be adjusted by movement of the bone conduction device.

FIG. 4 illustrates a bone conduction device 400 wherein operational characteristics of the bone conduction device may be adjusted by movement of the bone conduction device. In embodiments of the present invention, a recipient may adjust operational characteristics of the device by moving any portion of the device that is typically stationary, such as the housing of the device. Additionally, in certain embodiments, the recipient may adjust operational characteristics of the device by moving the device in accordance with certain controlling movements. As used herein, a "controlling movement" is a movement of a bone conduction device that the device is configured to detect for the purpose of adjusting an operational characteristic of the device. Exemplary controlling movements for a bone conduction device are illustrated in FIG. 4. In the embodiment shown in FIG. 4, operational characteristic of the device may be adjusted and/or altered by tilting bone conduction device 400 up or down in the direction of arrows 408. Operational characteristics may also be adjusted and/or altered by tilting the device to one side or the other as indicated by arrows 410. Further operational characteristics may be adjusted by tilting and holding the device in a particular orientation for a predetermined amount of time. In the embodiment illustrated in FIG. 4, tilting bone conduction device 400 up or down in the direction of arrows 408 and tilting the device to one side or the other as indicated by arrows 410 are "controlling movements" for device 400. As described in more detail below, these movements may be detected by an appropriate sensor module, such as sensor module 213 of the embodiment illustrated in FIG. 2.

Exemplary operational characteristics that may be adjusted and/or altered by movement of the bone conduction device include, for example, volume, power state (e.g., on/off state, sleep mode, etc.), amplification (e.g., the amount of amplification of various frequency ranges), compression, maximum power output (i.e., a restriction of the maximum power output related to the recipient's ability to hear at each frequency or frequency band), noise reduction, directivity of the sound received by the sound input elements, speech enhancement, damping of certain resonance frequencies (e.g., using electronic notch filters), the frequency and/or amplitude of an alarm signal, etc. In certain embodiments, control settings for the various operational characteristics may, for example, be organized in folders to aid the recipient in locating the appropriate control settings for adjustment of a desired operational characteristic. In such embodiments, bone conduction device 400 may, for example, include a speaker, vibration device, and/or use the transducer to provide audible and/or vibration information/instructions to the recipient in adjusting operational characteristics of the bone conduction device. Sensor module 213 may also allow the recipient to program the bone conduction device through movement of the bone conduction device.

Figure 5:
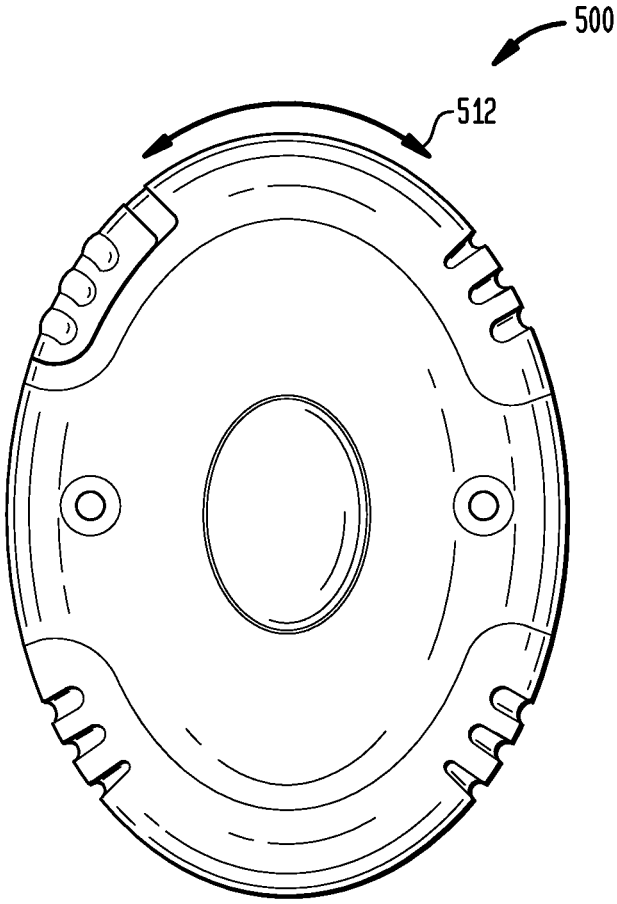
FIG. 5 illustrates another exemplary bone conduction device, in accordance with embodiments of the present invention, wherein operational characteristics of the bone conduction device may be adjusted by movement of the bone conduction device.

FIG. 5 illustrates another exemplary bone conduction device 500 wherein operational characteristics of the bone conduction device may be adjusted by movement of the bone conduction device. In this example, a recipient may adjust operational characteristics of bone conduction device 500 by twisting or moving the bone conduction device in the direction of arrows 512. Further operational characteristics may be adjusted by twisting and holding the device in a particular orientation for a predetermined amount of time. Additionally, the recipient may adjust operational characteristics by, for example, pulling the hearing device outwardly or pushing the hearing device inwardly. In embodiments of the present invention, a bone conduction device may allow a recipient to adjust operational characteristics of the bone conduction device through movement of the device in any one or more of the exemplary directions shown by arrows 408, 410 and 512. Additionally, although the embodiments are discussed with reference to the recipient making the adjustments, it should be understood that any user (e.g., the recipient, a doctor, a family member, friend, etc.) may move the bone conduction device to make these adjustments.

Figure 6:
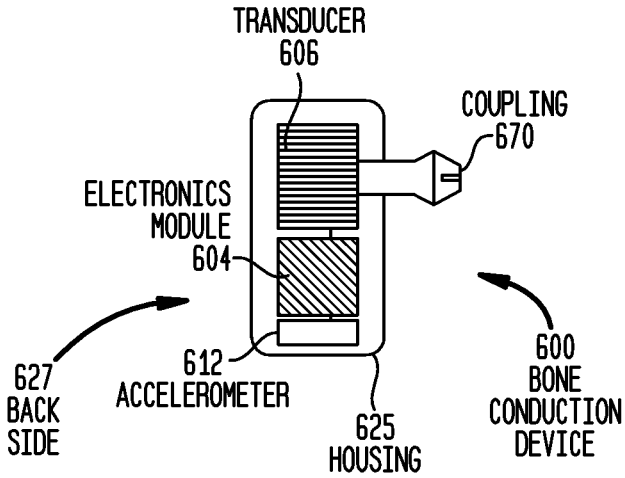
FIG. 6 is a schematic diagram of one embodiment of the bone conduction device of FIG. 3.

FIG. 6 is a schematic diagram of one embodiment of bone conduction device 300 of FIG. 3, referred to herein as bone conduction device 600. As shown, bone conduction device 600 comprises a transducer 606 disposed in housing 625, and a coupling 660 that is attached to transducer 606 and extends through housing 625. In certain embodiments, coupling 660 is fixed to transducer 606, but moveable relative to housing 625. For example, in some embodiments, transducer 606 is attached to housing 625 such that it is free to one or more of rotate, pivot, and otherwise move relative to housing 625.

Bone conduction device 600 further comprises an embodiment of sensor module 213 that includes an accelerometer 612 electrically connected to an electronics module 604. Electronics module 604 is also electrically connected to transducer 606. Accelerometer 612 is an embodiment of sensor 212, and is mounted inside housing 625. Because accelerometer 612 is mounted inside housing 625, accelerometer 612 is able to detect certain movements of housing 625. Specifically, accelerometer 612 is able to detect changes in orientation of housing 625. Accelerometer 612 may be a conventional accelerometer capable of measuring acceleration in one, two or three dimensions. In certain embodiments, the conventional accelerometer is capable of measuring acceleration as a vector (i.e., including magnitude and direction) and is also capable of measuring gravity. In the embodiment schematically illustrated in FIG. 6, accelerometer 612 detects the acceleration of a lower portion of housing 625, where accelerometer 612 is mounted. In other embodiments, accelerometer may be mounted elsewhere within housing 625 and measure the acceleration of another portion of housing 625 when mounted elsewhere.

By detecting the acceleration of housing 625 where accelerometer 612 is mounted, accelerometer 612 is able to detect changes in orientation of housing 625. By detecting these changes in orientation, accelerometer 612 is able to detect controlling movements of housing 625, thereby allowing the recipient to alter/adjust operational characteristics of bone conduction device 600 by moving bone conduction device 600. After adjusting one or more operational characteristics of device 600, transducer 606 may generate mechanical force for delivery to the recipient's skull (e.g., vibrate) in accordance with the one or more adjusted operational characteristics.

When coupling 660 is attached to an abutment implanted in the recipient's skull, a recipient may tilt housing 625 up (as shown by arrows 408 in FIG. 4) by, for example, pressing on the top of the device. In certain embodiments, when housing 625 is tilted up, accelerometer 612 detects the magnitude and direction of the acceleration of the lower portion of housing 625 as the lower portion of housing 625 accelerates away from the recipient's skull. Bone conduction device 600 then determines whether the detected acceleration is indicative of a pre-defined controlling movement of housing 625, such as tilting the housing up, as described in relation to FIG. 4. In some embodiments, accelerometer 612 provides an indication of the detected acceleration to electronics module 604, which determines whether the detected acceleration is indicative of a pre-defined controlling movement of housing 625. In other embodiments, accelerometer 612 may include control electronics configured to determine whether a detected acceleration is indicative of a controlling movement of housing 625 and indicate to electronics module 604 that there has been a controlling movement of housing 625. In certain embodiments, in response to the detection of a controlling movement of housing 625, electronics module 604 may adjust and/or alter an operational characteristic of device 600, such as increasing the volume of the device.

Similarly, when housing 625 is tilted down, accelerometer 612 detects the magnitude and direction of the acceleration of the lower portion of housing 625 as the lower portion of housing 625 accelerates toward the recipient's skull. In response, device 600 may determine that there has been a controlling movement of housing 625 (i.e., tilt down), and electronics module 604 may adjust and/or alter an operational characteristic of device 600, such as decreasing the volume of the device. Device 600 may similarly use accelerometer 612 to detect a large number of other controlling movements of housing 625 including, but not limited to, tilting housing 625 side to side in the direction of arrows 410, tilting housing 625 diagonally in one or more directions between arrows 408 and 410, twisting housing 625 in the direction of arrows 512, snapping the device onto and off of an implanted abutment, etc., each of which will produce a characteristic acceleration that may be identified by device 600.

In addition, by analyzing the magnitude of the acceleration detected by accelerometer 612, device 600 may distinguish between controlling movements of different forces experienced by housing 625. For example, accelerometer 612 may detect an acceleration of lesser magnitude when housing 625 is tilted up by a relatively light touch on the upper portion of housing 625 than when housing 625 is tilted up by a harder touch on the upper portion of housing 625. As such, electronics module 604 may provide different controls of operational characteristics based on the force of controlling movements of housing 625. For example, electronics module 604 may increase the volume of device 600 by a relatively small amount in response to a light touch on an upper portion of housing 625 (i.e., a light upward tilt), and increase the volume of device 600 by a larger amount in response to a more forceful touch on an upper portion of housing 625 (i.e., a more forceful upward tilt). Similarly, electronics module 604 may decrease the volume of device 600 by a relatively small amount in response to a light touch on a lower portion of housing 625 (i.e., a light downward tilt), and decrease the volume of device 600 by a larger amount in response to a more forceful touch on a lower portion of housing 625 (i.e., a more forceful downward tilt).

Electronics module 604 may also provide different adjustments of operational characteristics based on a number of consecutive controlling movements of housing 625. For example, performing one controlling movement of housing 625 in a certain period of time may adjust one operational characteristic of device 600, while performing the same movement twice in a predetermined period of time may adjust another operational characteristic of device 600. For example, tilting housing 625 up once in a predetermined period of time may cause electronics module 604 to adjust the volume of device 600, while tilting housing 625 up twice in the predetermined period of time may cause electronics module 604 to adjust the power state of the device.

Electronics module 604 may also provide different adjustments of operational characteristics based on whether a controlling movement of housing 625 is performed and held. Such a manipulation of housing 625 may be detected by accelerometer 612 by, for example, detecting a characteristic acceleration for the controlling movement and then detecting little or no acceleration in the opposite direction for a predetermined period of time. For example, performing a controlling movement of housing 625 and immediately releasing housing 625 may adjust one operational characteristic of device 600, while performing the same movement and then holding housing 625 in a specific orientation for a predetermined period of time may adjust another operational characteristic of device 600. For example, tilting housing 625 up and then quickly releasing housing 625 may cause electronics module 604 to adjust the volume of device 600, while tilting housing 625 up and then holding the device in the upwardly-tilted orientation for a predetermined period of time may cause electronics module 604 to adjust the power state of the device.

In embodiments of the invention, any of the controlling movements described above may be mapped to the adjustment of any operational characteristics of device 600. This mapping of adjustments to controlling movements may be defined in the software (or firmware) of device 600. For example, in some embodiments, the mapping may be specified in software for electronics module 604. In addition, the mapping for device 600 may be change when the mapping is specified in software. In addition, a controlling movement performed multiple times, at a greater force, or performed and held may be considered to be a different controlling movement than the same controlling movement performed once, with lesser force, or performed and not held, for example, and these different controlling movements may be mapped to the adjustment of different operational characteristics.

In some embodiments, device 600 may use accelerometer 612 to detect when there has been no movement of device 600 for a predetermined period of time. No movement of device 600 for a predetermined period of time may indicate that device 600 is no longer connected to the recipient and should therefore be turned off. In embodiments, upon determining that there has been no movement of device 600 for a predetermined period of time, device 600 may turn itself off or enter a sleep mode, for example. In some embodiments, accelerometer 612 may provide an indication to electronics module after accelerometer 612 has experienced no acceleration (relative to when accelerometer 612 is at rest, for example) for a predetermined period of time. In response to the indication from accelerometer 612, electronics module 604 may power down device 600 or cause device 600 to enter a sleep mode. In other embodiments, electronics module 604 may monitor the output of accelerometer 612 and power down device 600 or cause device 600 to enter a sleep mode when no indication of acceleration has been received from accelerometer 612 for a predetermined period of time. In some embodiments, electronics module 604 may monitor accelerometer 612 in sleep mode and cause device 600 to enter an operational mode (i.e., a mode in which device 600 is fully operational) in response to an indication that accelerometer 612 has detected acceleration of housing 625.

Alternatively or in addition, device 600 may use accelerometer 612 to detect a stationary orientation of housing 625. Housing 625 being stationary in a particular orientation may indicate that device 600 is not currently being worn by the recipient and should be turned off or enter a sleep mode. In certain embodiments, electronics module 604 may cause device 600 to enter a sleep mode when accelerometer 612 indicates that device 600 is lying flat on back side 627 of housing 625. Back side 627 is a side of housing 625 that is disposed opposite the side of housing 625 from which coupling 660 exits housing 625. In such embodiments, accelerometer 612 may be an accelerometer designed to detect gravity and may determine the orientation of the device by detecting the direction of the Earth's gravity. In other embodiments, the orientation of device 600 may be detected using a separate gravity detector, such as a gravimeter. Electronics module 604 may be configured to cause device 600 to enter sleep mode immediately upon detecting a particular orientation of device 600.

In addition, in certain embodiments, accelerometer 612 or one or more additional accelerometers may be used to sense vibrations of housing 625. Electronics module 604 may use the sensed vibrations to cancel feedback from the sound signal output from a sound input element (e.g., sound input element 202 of FIG. 2) of device 606. In addition, feedback noise may be generated when the recipient makes contact with the device in order to change operational characteristics of the device, or when the recipient is wearing a hat that makes contact with the device, for example. In some embodiments, accelerometer 612 may be used to sense these and other types of contact with the device, and electronics module 604 may increase feedback cancellation when such contact is detected. In other embodiments, electronics module 604 may reduce the volume, mute the device, or adjust some other operational characteristic of the device when such contact is detected. Additionally, electronics module 604 may reverse these changes when accelerometer detects that the detected contact is no longer present.

Alternatively or in addition, the sensed vibrations could also be used to monitor the functioning of transducer 606. For example, in some embodiments, transducer 606 is configured to vibrate housing 625 directly and includes a vibrating mass and a suspension. In such embodiments, the functioning of the suspension could be monitored by comparing the sensed vibrations of housing 625 to a control signal driving transducer 606. If the sensed vibrations depart from the vibrations specified by the control signal driving transducer 606, it may be determined that the suspension is not working properly.

In certain embodiments, device 600 may further comprise a recording device for recording the movements of housing 625, as measured by accelerometer 612. The recording device may be any memory device suitable for recording the output of accelerometer 612. The recorded output of accelerometer 612 may be useful during diagnosis or repair of device 600. For example, if device 600 has been dropped, the change in acceleration experienced upon impact with the ground may be detected by accelerometer 612 and recorded in the recording device. This recorded change in acceleration may be used by a technician to determine that device 600 has been dropped. Similarly, the lack of any such recorded change in acceleration may indicate that the device was not dropped, which may assist the technician in diagnosing a problem with device 600. As such, recorded accelerations may assist a technician in identifying a correct diagnosis or failure mode of device 600.

In some embodiments, an additional accelerometer may be attached to coupling 660. Electronics module 604 may compare the acceleration detected by the additional accelerometer to the acceleration detected by accelerometer 612 during the same period of time to sense the movement of housing 625 relative to coupling 660. In such embodiments, electronics module 604 may detect various controlling movements of housing 625 by detecting certain movements of housing 625 relative to coupling 660. For example, if electronics module 604 determines that a lower portion of housing 625 has been moved away from coupling 660, electronics module 604 may determine that housing 625 has been tilted up in the direction of arrow 408 of FIG. 4. Similarly, if electronics module 604 determines that a lower portion of housing 625 has been moved toward coupling 660, electronics module 604 may determine that housing 625 has been tilted down in the direction of arrow 408 of FIG. 4.

In other embodiments of the present invention, a sound input element of device 600 may be an accelerometer that detects sound via vibration of a surface such as housing 625. Alternatively, a sound input element of device 600 may be a microphone that includes an accelerometer to cancel any effect of acceleration on the microphone so that the microphone is insensitive to acceleration. In such embodiments, the accelerometer of the sound input element may be used to perform the functions of accelerometer 612 described above, and accelerometer 612 may be omitted from the device. Alternatively, the accelerometer of the sound input device may be used in conjunction with accelerometer 612 described above.

Alternatively or in addition to other features describe herein, operational characteristics of a bone conduction device may be adjusted and/or altered in response to the detection of one or more characteristic sounds. For example, the sound of a recipient tapping on housing 325 of bone conduction device 300 may be received via one or more of microphones 302A and 302B. In certain embodiments, electronics module 304 is configured to distinguish the characteristic sound of a recipient or other user tapping on housing 325 from other sound received by a microphone 302. In such embodiments, electronics module 304 may be configured to adjust and/or alter one or more operational characteristics of device 300 in response to detecting, via one or more of microphones 302A and 302B, the characteristic sound produced by the recipient tapping on housing 325. Alternatively or in addition, electronics module 304 may be configured to adjust and/or alter one or more operational characteristics of device 300 in response to detecting any one of a plurality of predefined patterns of tapping on housing 325, such as two or more consecutive taps. As one example, electronics module 304 may cause device 300 to enter a sleep mode in response to detecting two consecutive taps on housing 325. In other embodiments, a sound input device including an accelerometer, as described above, may be used to detect tapping on the housing by using the accelerometer to detect vibrations of the housing caused by tapping on the housing.

In other embodiments, electronics module 304 is configured to distinguish the characteristic sound of a recipient moving a finger or other object across a specially textured portion 315 of housing 325 of FIG. 3. In embodiments, portion 315 is configured with a texture that causes a characteristic sound to be generated when an object is slid across portion 315. In such embodiments, electronics module 304 may be configured to adjust and/or alter one or more operational characteristics of device 300 in response to detecting, via one or more of microphones 302A and 302B, the characteristic sound produced by sliding an object across textured portion 315. In embodiments, textured portion 315 is designed to produce a characteristic sound that is picked up by one or more of microphones 302A and 302B and which electronics module 304 is able to distinguish from other sounds picked up by microphones 302A and 302B. The characteristic sound may be distinguished by signal processing electronics in electronics module 304. As one example, electronics module 304 may cause device 300 to enter a sleep mode in response to detecting an object moving across textured portion 315.

In still other embodiments, electronics module 304 is configured to distinguish the characteristic sound of coupling 360 being snapped onto and off of abutment 364. In such embodiments, electronics module 304 may be configured to adjust and/or alter one or more operational characteristics of device 300 in response to detecting, via one or more of microphones 302A and 302B, the characteristic sound produced by snapping coupling 360 onto and off of abutment 364. For example, electronics module 304 may cause device 300 to enter a sleep mode in response to detecting an the sound of coupling 360 being snapped off of abutment 364 and may cause device 300 to enter a fully operational mode in response to detecting an the sound of coupling 360 being snapped onto abutment 364.

Figure 7:
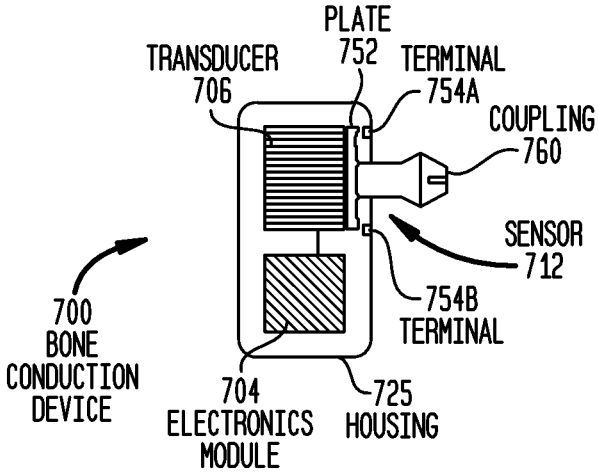
FIG. 7 is a schematic diagram of another embodiment of the bone conduction device of FIG. 3.

FIG. 7 is a schematic diagram of another embodiment of bone conduction device 300 of FIG. 3, referred to herein as bone conduction device 700. As shown, bone conduction device 700 comprises a transducer 706 disposed in housing 725, and a coupling 760 that is mounted to transducer 706 and extends through housing 725. Bone conduction device 700 further comprises an embodiment of sensor module 213 that includes a sensor 712 that is electrically connected to an electronics module 704. Electronics module 704 is also electrically connected to transducer 706.

Sensor 712 comprises a plate 752 and electrically-conductive contacts 754A and 754B mounted to the inside of housing 725. In the embodiment illustrated in FIG. 7, coupling 706 is mounted to plate 752, and plate 752 is mounted to transducer 706, thereby connecting coupling 760 to transducer 706. In alternative embodiments, coupling 760 may be mounted directly to transducer 706, and plate 752 may be mounted to coupling 760 such that it is separated from transducer 706. In embodiments of the present invention, plate 752 is at least partially electrically conductive. Contacts 754A and 754B are disposed around the portion of housing 725 at which coupling 760 exits housing 725. Plate 752 and each of contacts 754A and 754B are electrically connected to electronics module 704. While two contacts 754A and 754B are shown in the embodiment illustrated in FIG. 7, it will be appreciated that one or more than two contacts may be provided inside housing 725.

In the embodiment shown in FIG. 7, coupling 760 is fixed to transducer 706 such that there is substantially no movement of coupling 760 relative to transducer 706, and coupling 760 and transducer 706 together are moveable relative to housing 725. In some embodiments, transducer 706 is attached to housing 725 such that it is free to one or more of rotate, pivot, and otherwise move relative to housing 725. This movement of transducer 706 relative to housing 725 allows relative movement of housing 725 relative to coupling 760.

In embodiments of the present invention, the sensor module is able to detect controlling movements of device 700 by detecting movement of housing 725 relative to coupling 760 using sensor 712. In embodiments, the movement of housing 725 relative to coupling 760 is detected through the contact of plate 752 with one of terminals 754A and 754B. When coupling 760 is attached to an abutment implanted in the recipient's skull, a recipient may tilt housing 725 up (as shown by arrows 408 in FIG. 4) by pressing on the top of the device, for example. In certain embodiments, housing 725 may be tilted such that an electrically conductive portion of plate 752 makes contact with terminal 754A.

The contact between plate 752 and terminal 754A is detected by electronics module 704, which is electrically connected to both plate 752 and terminal 754A. Sensor 712 may be configured such that an electrical circuit is completed when plate 752 makes contact with terminal 754A, and electronics module 704 may detect the completion of the electrical circuit. In accordance with other embodiments of the present invention, electronics module 704 may detect contact between plate 752 and terminal 754A by checking the impedance of a line connected to plate 752 or terminal 754A, or by any other currently known or later developed method.

Electronics module 704 determines that there has been a controlling movement of device 700 when it detects contact between plate 752 and terminal 754A. In certain embodiments, in response to the detection of a controlling movement of device 700, electronics module 704 may adjust and/or alter an operational characteristic of device 700. In embodiments, operational characteristics of device 700 may be the same as those described above in relation to device 600. Similarly, electronics module 704 determines that there has been a controlling movement of device 700 when it detects contact between plate 752 and terminal 754B, which may occur when the recipient tilts housing 725 down (as shown by arrows 408 in FIG. 4) by pressing on the bottom of device 700, for example. In the embodiment illustrated in FIG. 7, terminals 754 are electrically isolated from one another and electronics module 704 determines whether the housing has been tilted up or down based on which terminal 754 is contacted by plate 752. After adjusting one or more operational characteristics, transducer 706 may generate mechanical force for delivery to the recipient's skull (e.g., vibrate) in accordance with the one or more adjusted operational characteristics.

In other embodiments, the inside of housing 725 may include additional terminals 754 that are electrically isolated from one another and oriented at various locations around the portion of housing 725 where coupling 760 exits housing 725. In this manner, electronics module 704 may detect additional controlling movements of device 700. For example, when terminals 754 are placed on the inside of housing 725 on left and right sides of coupling 760, electronics module 704 is capable of detecting tilting of device 700 to one side or the other as indicated by arrows 410 in FIG. 4. In embodiments, electronics module 704 is able to detect additional controlling movements of device 700, such as various degrees of diagonal tilting, when additional terminals 754 are disposed on the inside of housing 725.

Additionally, in embodiments, plate 752 may be subdivided into a plurality of conductive areas that are electrically isolated from one another by one or more non-conductive dividers, for example. Each of the conductive areas may be separately connected to electronics module 704. The number of conductive areas and their positions may correspond to the number and positions of terminals 754 of device 700. In such embodiments, electronics module 704 is able to detect, for example, the completion of a circuit between a specific terminal and a specific conductive portion of plate 752. In alternative embodiments, each of terminals 754 may be electrically connected to one another. In such embodiments, electronics module 704 detects controlling movements of device 700 but does not distinguish between certain controlling movements. For example, in such embodiments, such that electronics module 704 would not distinguish between tilting device 700 up and tilting device 700 down.

Electronics module 704 may also provide different adjustments of operational characteristics based on whether a controlling movement of housing 725 is performed and held. Such a manipulation of housing 725 may be detected by sensor module 704 by, for example, detecting contact between plate 752 and a terminal 754 that is maintained for a predetermined period of time. For example, performing a controlling movement of housing 725 and immediately releasing housing 725 may adjust one operational characteristic of device 700, while performing the same movement and then holding housing 725 in a specific orientation for a predetermined period of time may adjust another operational characteristic of device 700, as described above in relation to device 600.

Figure 8A:
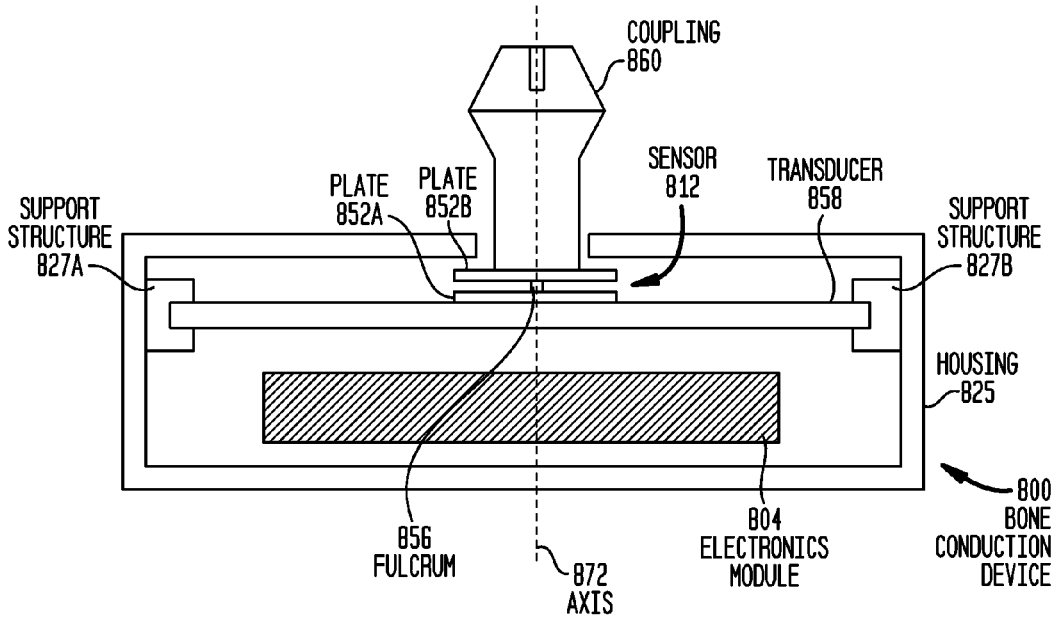
FIGS. 8A and 8B are schematic diagrams of another embodiment of the bone conduction device of FIG. 3.
Figure 8B:
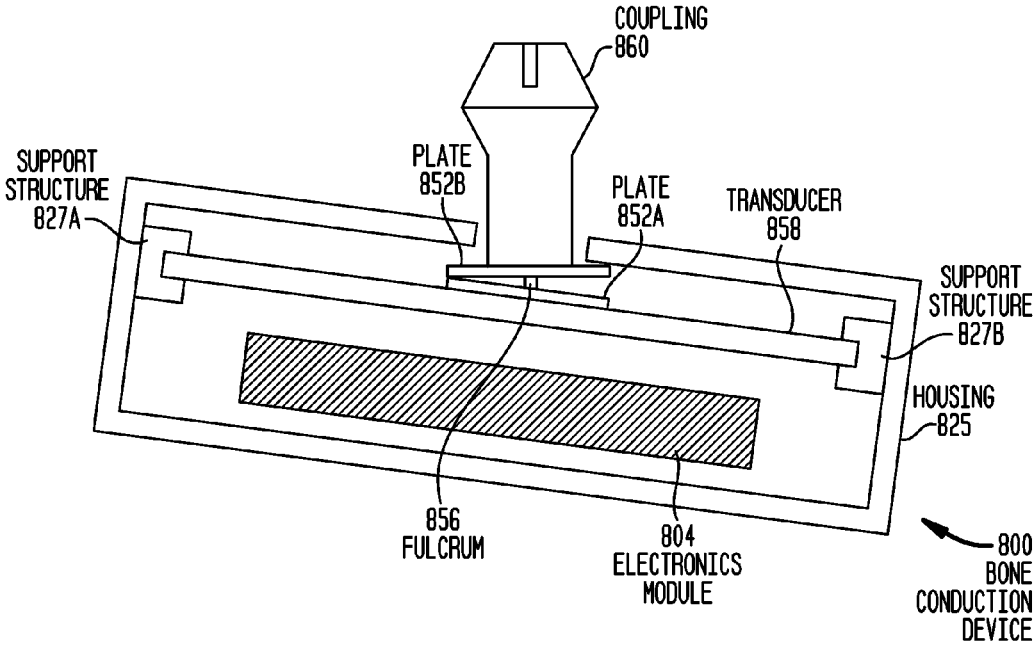

FIGS. 8A and 8B are schematic diagrams of another embodiment of bone conduction device 300 of FIG. 3, referred to herein as bone conduction device 800. As shown, bone conduction device 800 comprises a transducer 858 connected to housing 825 by support structures 827A and 827B. Bone conduction device 800 further comprises an embodiment of sensor module 213 that includes a sensor 812 that is electrically connected to an electronics module 804. Electronics module 804 is also electrically connected to transducer 858. A coupling 860 extends through housing 825 and is mounted to transducer 858 via sensor 812.

In the embodiment illustrated in FIGS. 8A and 8B, sensor 812 includes first and second plates 852A and 852B coupled by a fulcrum 856. In embodiments, first plate 852A is attached to transducer 858 such that there is substantially no movement of first plate 852A relative to transducer 858, and second plate 852B is attached to coupling 860 such that there is substantially no movement of second plate 852B relative to coupling 860. Fulcrum 856 enables the movement of housing 825 relative to coupling 860. More specifically, in embodiments, fulcrum 856 enables plates 852A and 852B to pivot or rotate about fulcrum 856, as shown in FIG. 8B, and fulcrum 856 substantially prevents the relative translation of plates 852A and 852B toward or away from one another along axis 872.

In embodiments of the present invention, the sensor module is able to detect controlling movements of device 800 by detecting movement of housing 825 relative to coupling 860 using sensor 812. In embodiments, the movement of housing 825 relative to coupling 860 is detected by detecting the contact of plate 852A with plate 852B. When coupling 860 is attached to an abutment implanted in the recipient's skull, a recipient may tilt housing 825 up (as shown by arrows 408 in FIG. 4) by pressing on the top of the device, for example. In embodiments, housing 825 may be tilted such that a portion of plate 852A makes contact with a portion of plate 852B, as illustrated in FIG. 8B. In certain embodiments, each of plates 852A and 852B is at least partially electrically conductive and each of plates 852A and 852B is electrically connected to electronics module 804. In such embodiments, electronics module 804 detects contact between conductive portions of plates 852A and 852B. For example, sensor module 812 and electronics module 804 may be configured such that an electrical circuit is completed when a conductive portion of plate 852A makes contact with a conductive portion of plate 852B. In accordance with other embodiments of the present invention, electronics module 804 may detect contact between conductive portions of plates 852A and 852B by checking the impedance of a line connected to plate 852A or plate 852B, or by any other currently known or later developed method.

In certain embodiments, electronics module 804 determines that there has been a controlling movement of device 800 when it detects contact between conductive portions of plates 852A and 852B. In such embodiments, electronics module 804 may adjust and/or alter an operational characteristic of device 800 in response to the detection of a controlling movement of device 800. In embodiments, operational characteristics of device 800 may be the same as those described above in relation to device 600. After adjusting one or more operational characteristics of device 800, transducer 858 may generate mechanical force for delivery to the recipient's skull (e.g., vibrate) in accordance with the one or more adjusted operational characteristics.

In some embodiments, each of plates 852A and 852B may be subdivided into a plurality of conductive areas that are electrically isolated from one another by one or more non-conductive dividers, for example. Each of the conductive areas may be separately connected to electronics module 804. The number of conductive areas in plates 852A and 852B may correspond to the number of controlling movements of device 800 that sensor 812 detects. In such embodiments, electronics module 804 detects a specific controlling movement of device 800 by detecting contact between specific conductive areas of plates 82A and 852B. In one exemplary embodiment, for example, electronics module 804 may detect that housing 825 is tilted in one direction relative to coupling 860 (e.g., as shown in FIG. 8B) by detecting contact between a first conductive portion of plate 852A and a first conductive portion of plate 852B. Similarly, electronics module 804 may detect that housing 825 is tilted in another direction relative to coupling 860 (e.g., opposite to the movement shown in FIG. 8B) by detecting contact between a second conductive portion of plate 852A and a second conductive portion of plate 852B. In other embodiments, plates 852A and 852B may each be divided into more than two conductive areas to allow detection of more than two controlling movements of device 800, such as various degrees of diagonal tilting of device 800. In still other embodiments, only one of plates 852A and 852B may be divided into conductive areas, while the other is a single conductive plate. In such embodiments, electronics module 804 distinguishes between different controlling movements based upon which portion of the divided plate the other plate contacts.

Electronics module 804 may also provide different adjustments of operational characteristics based on whether a controlling movement of housing 825 is performed and held. Such a manipulation of housing 825 may be detected by sensor module 804 by, for example, detecting contact between plates 852A and 852B that is maintained for a predetermined period of time. For example, performing a controlling movement of housing 825 and immediately releasing housing 825 may adjust one operational characteristic of device 800, while performing the same movement and then holding housing 825 in a specific orientation for a predetermined period of time may adjust another operational characteristic of device 800, as described above in relation to device 600.

Figure 9A:
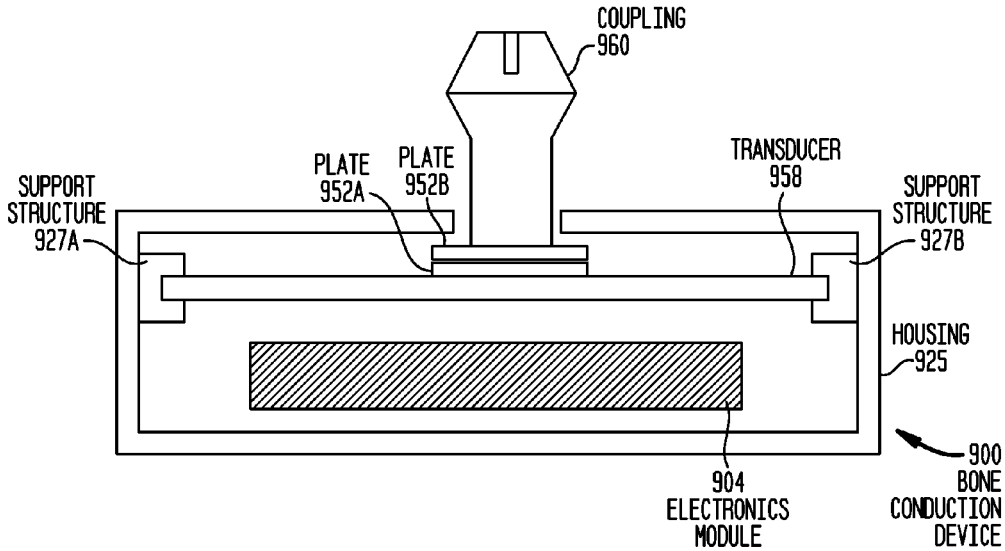
FIGS. 9A and 9B are schematic diagrams of another embodiment of the bone conduction device of FIG. 3.
Figure 9B:
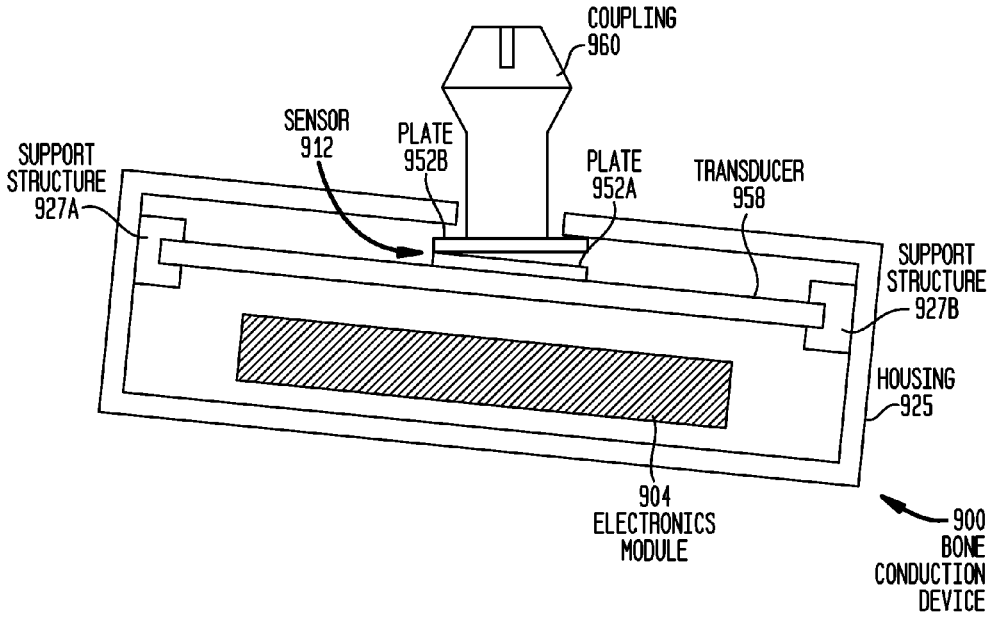

FIGS. 9A and 9B are schematic diagrams of another embodiment of bone conduction device 300 of FIG. 3, referred to herein as bone conduction device 900. As shown, bone conduction device 900 comprises a transducer 958 connected to housing 925 by support structures 927A and 927B. Bone conduction device 900 further comprises an embodiment of sensor module 213 that includes a sensor 912 that is electrically connected to an electronics module 904. Electronics module 904 is also electrically connected to transducer 958. A coupling 960 extends through housing 925 and is mounted to transducer 958 via sensor 912.

In the embodiment illustrated in FIGS. 9A and 9B, sensor 912 includes first and second magnetic plates 952A and 952B. In embodiments, first magnetic plate 952A is attached to transducer 958 such that there is substantially no movement of first plate 952A relative to transducer 958, and second magnetic plate 952B is attached to coupling 960 such that there is substantially no movement of second magnetic plate 952B relative to coupling 960. Magnetic plates 952A and 952B are configured to be magnetically attracted to one another.

In embodiments of the present invention, the sensor module is able to detect controlling movements of device 900 by detecting movement of housing 925 relative to coupling 960 using sensor 912. In embodiments, the movement of housing 925 relative to coupling 960 is detected by detecting the separation of magnetic plate 952A from magnetic plate 952B. When coupling 960 is attached to an abutment implanted in the recipient's skull, a recipient may tilt housing 925 up (as shown by arrows 408 in FIG. 4) by pressing on the top of the device, for example. In embodiments, housing 925 may be tilted such that the magnetic attraction of plates 952A and 952B is partially overcome and a portion of plate 952A is separated from plate 952B, as illustrated in FIG. 9B. In certain embodiments, each of magnetic plates 952A and 952B is at least partially electrically conductive and each of plates 952A and 952B is electrically connected to electronics module 904. In such embodiments, electronics module 904 detects the separation of conductive portions of plates 952A and 952B. For example, sensor 912 and electronics module 904 may detect that an electrical circuit is broken when a conductive portion of plate 952A is separated from a conductive portion of plate 952B. In accordance with other embodiments of the present invention, electronics module 904 may detect the separation of conductive portions of plates 952A and 952B by checking the impedance of a line connected to plate 952A or plate 952B, or by any other currently known or later developed method.

In certain embodiments, electronics module 904 determines that there has been a controlling movement of device 900 when it detects the separation of conductive portions of plates 952A and 952B. In such embodiments, electronics module 904 may adjust and/or alter an operational characteristic of device 900 in response to the detection of a controlling movement of device 900. In embodiments, operational characteristics of device 900 may be the same as those described above in relation to device 600. In some embodiments, each of plates 952A and 952B may be subdivided into a plurality of conductive areas that are electrically isolated from one another to allow electronics module 904 to distinguish between different controlling movements of device 900 similar to the manner described above in relation to device 800, except that electronics module 904 detects the separation of plates 952A and 952B rather than contact of the plates. In certain embodiments, electronics module 904 may also be configured to detect the twisting housing 925 (as shown by arrow 512 of FIG. 5) by detecting the twisting of plates 952A and 952B, which may be detected by detecting changes in the alignment of the subdivided conductive areas of plates 952A and 952B. After adjusting one or more operational characteristics of device 900, transducer 958 may generate mechanical force for delivery to the recipient's skull (e.g., vibrate) in accordance with the one or more adjusted operational characteristics.

Electronics module 904 may also provide different adjustments of operational characteristics based on whether a controlling movement of housing 925 is performed and held. Such a manipulation of housing 925 may be detected by electronics module 904 by, for example, detecting a separation of portions of plates 952A and 952B that is maintained for a predetermined period of time. For example, performing a controlling movement of housing 925 and immediately releasing housing 925 may adjust one operational characteristic of device 900, while performing the same movement and then holding housing 925 in a specific orientation for a predetermined period of time may adjust another operational characteristic of device 900, as described above in relation to device 600.

Figure 10:
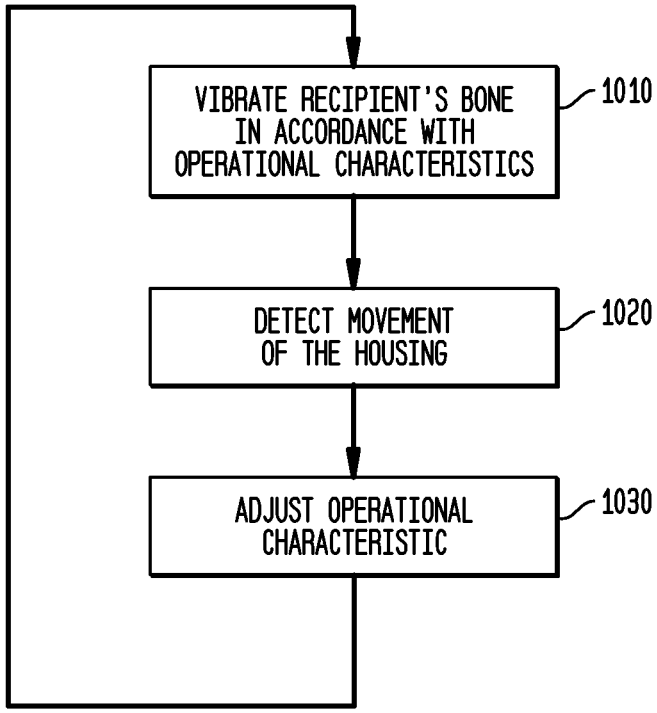
FIG. 10 is a flowchart illustrating one way of operating a bone conduction device in accordance with embodiments of the present invention.

FIG. 10 is a flowchart illustrating one way of operating a bone conduction device in accordance with embodiments of the present invention. At block 1010 of FIG. 10, bone conduction device 200 vibrates the recipient's skull in accordance with operational characteristics of device 200 by generating a mechanical output force that is delivered to the recipient's skill via an anchor system 208 coupled to bone conduction device 200, as described above. At block 1020, electronics module 204 detects movement of housing 225 via sensor module 213. The sensor module may be any one of the sensor modules described above in relation to embodiments of the invention, and may detect movement of housing 225 in any of the ways described above in relation to embodiments of the invention. Once electronics module 204 detects movement of housing 225, electronics component 204 adjusts one or more operational characteristics of device 200 at block 1030 of FIG. 10. The one or more operational characteristics may be any of the operational characteristics described above. After one or more operational characteristics are adjusted at block 1030, bone conduction device 200 may again vibrate the recipient's skull in accordance with the adjusted operational characteristics of device 200 at block 1010. Additionally, while the above flowchart has been described in relation to bond conduction device 200, any of the bone conduction devices described above in relation to embodiments of the present invention may be operated in accordance with the flowchart illustrated in FIG. 10.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents. The present embodiments are, therefore, to be considered in all respects as illustrative and not restrictive.

What is claimed is:

1. A bone conduction device comprising:

a coupling configured to couple the device to a bone;

a transducer module configured to vibrate in accordance with one or more operational characteristics of the device; and a sensor module configured to adjust the one or more operational characteristics to thereby adjust an output of the transducer in response to one or more of: a reorientation of a first portion of the device relative to the bone; and a movement of the first portion relative to the coupling.

2. The device of claim 1, wherein the transducer module is disposed in the first portion.

3. The device of claim 1, wherein the sensor module comprises:

an electronics module;

a plate mounted to the transducer module, wherein the plate is at least partially electrically conductive; and one or more terminals mounted to the first portion.

4. The device of claim 3, wherein the plate and the terminals are each electrically connected to the electronics module and the sensor module is further configurable to detect contact between the plate and at least one of the terminals.

5. The device of claim 1, wherein the sensor module comprises:

an electronics module;

a first plate mounted to the transducer module, wherein the plate is at least partially electrically conductive;

a second plate mounted to the coupling; and a fulcrum attaching the first and second plates, wherein the fulcrum is configurable to allow movement of the first and second plates relative to one another.

6. The device of claim 5, wherein the first and second plates are each electrically connected to the electronics module and the sensor module is further configurable to detect contact between the first and second plates.

7. The device of claim 6, wherein the first plate comprises first and second electrically conductive areas electrically isolated from one another, and the sensor module is configurable to adjust a first one of the one or more operational characteristics in response to a detection of contact between the first area and the second plate and to adjust a second one of the one or more operational characteristics in response to contact between the second area and the second plate.

8. The device of claim 1, wherein the sensor module comprises:

an electronics module;

a first magnetic plate mounted to the transducer module, wherein the first magnetic plate is at least partially electrically conductive; and a second magnetic plate mounted to the coupling and configurable to magnetically attract the first magnetic plate, wherein the second magnetic plate is at least partially electrically conductive.

9. The device of claim 8, wherein the first and second magnetic plates are each electrically connected to the electronics module and the sensor module is further configurable to detect separation of portions the first and second magnetic plates.

10. The device of claim 1, wherein the sensor module comprises:

an accelerometer mounted to the first portion and configured to detect the reorientation of the first portion relative to the bone.

11. The device of claim 10, further comprising:

a sound input device configurable to receive sound signals and generate a plurality of signals representative of the sound signals, wherein the accelerometer is further configurable to detect a vibration of the first portion and the sensor module is further configurable to cancel feedback from the sound signals based on the vibration.

12. The device of claim 11, wherein the coupling is configurable to snap onto and off of a component disposed in a bone, and wherein the sensor module is further configurable to adjust the one or more operational characteristics in response to the coupling being snapped onto or off of the component.

13. The device of claim 10, wherein the sensor module is further configurable to turn off the device in response to a predetermined period of time elapsing without the reorientation of the first portion relative to the bone.

14. The device of claim 10, wherein the sensor module is further configured to turn off the device in response to the device being flat on a back side of the first portion.

15. The device of claim 1, wherein the sensor module is further configured to adjust the one or more operational characteristics in response to the sound of one or more taps on the first portion.

16. The device of claim 1, wherein the first portion further comprises a textured portion configurable to generate a characteristic sound when an object is slid across the textured portion, and wherein the sensor module is further configurable to adjust the one or more operational characteristics in response to the characteristic sound.

17. The device of claim 1, wherein the first portion comprises a housing.

18. The device of claim 1, wherein the sensor module is disposed in the first portion.

19. The device of claim 1, wherein the coupling extends from the first portion.

20. The device of claim 1, wherein the transducer module is attached to the coupling.

21. A method of operating a bone conduction device comprising a sensor, a coupling and a transducer, the method comprising:

vibrating a bone, via the coupling, in accordance with one or more operational characteristics of the device; and adjusting the one or more operational characteristics of the device to thereby adjust an output of the transducer in response to at least one of: a reorientation of a first portion of the device relative to the bone, and a movement of the first portion relative to the coupling.

22. The method of claim 21, wherein the adjusting the one or more operational characteristics comprises using contact between a plate mounted to the transducer and a terminal mounted to the first portion to detect movement of the first portion relative to the coupling.

23. The method of claim 21, wherein the adjusting the one or more operational characteristics comprises using an accelerometer to detect the reorientation of the first portion.

24. The method of claim 21, further comprising:

receiving sound signals via a sound input device;

generating a plurality of signals representative of the sound signals;

detecting vibration of the first portion via an accelerometer; and canceling feedback from the sound signals based on the detecting.

25. The method of claim 21, wherein the first portion comprises a textured portion configurable to generate a characteristic sound when an object is slid across the textured portion, the method further comprising:

adjusting the one or more of the operational characteristics of the device in response to detecting, via a sound input device, the characteristic sound.

26. A bone conduction hearing device, comprising:

an outer housing;

a coupling configured to couple the device to a bone of a person;

a transducer configured to transmit vibrational force to the bone to cause a sound perception by the person; and a sensor configured to sense a movement of the outer housing relative to the bone of the person, wherein the device is configured to change at least one operational characteristic of the transducer to alter the sound perception of the person in response to the sensed movement.

27. The bone conduction hearing device of claim 26, wherein the changeable operational characteristic of the transducer is at least one of a volume setting, a power state, an amplification setting, a compression setting, a maximum power output setting, a noise reduction setting, a sound directivity setting, a speech enhancement setting, a damping setting, and an alarm signal setting.

28. The bone conduction hearing device of claim 26, wherein the coupling is movably coupled to other portions of the device and wherein the sensor is configured to sense a movement of the outer housing relative to the coupling to change the at least one operational characteristic.

29. The bone conduction hearing device of claim 28, wherein the coupling can be tilted relative to the housing.

* * * * *